United States Patent [19]

Shavit et al.

[11] 4,402,460

[45] Sep. 6, 1983

[54] ROTARY SPRINKLER

[75] Inventors: Amos Shavit; Moshe Gorney, both of Kibbutz Naan, Israel

[73] Assignee: Naan Mechanical Works, Kibbutz Naan, Israel

[21] Appl. No.: 279,082

[22] Filed: Jun. 30, 1981

[30] Foreign Application Priority Data

Jul. 9, 1980 [IL] Israel ..... 60529

[51] Int. Cl.[3] ..... B05B 3/02

[52] U.S. Cl. ..... 239/230; 239/233

[58] Field of Search ..... 239/230–233

[56] References Cited

U.S. PATENT DOCUMENTS 3,581,994 6/1971 Heiberger ..... 239/233 X

*Primary Examiner*—John J. Love
*Assistant Examiner*—Gene A. Church
*Attorney, Agent, or Firm*—Finnegan, Henderson, Farabow, Garrett & Dunner

[57] ABSTRACT

A sprinkler including a body defining a nozzle arranged to provide a stream of pressurized liquid, spring loaded stream deflector and hammer apparatus for intermittently engaging the stream and providing in response to the engagement of a force causing intermittent rotation of the body about a rotation axis, apparatus for selectably limiting the amplitude of motion of the stream deflector and hammer apparatus and thus determining the direction of rotation of the body and the overall range of the spray produced and having first and second orientations corresponding to rotation in forward and return directions, selectably positionable protrusion apparatus for defining the azimuthal limits of a desired irrigation zone; and finger apparatus associated with the selectably limiting apparatus constructed such that positioning of the finger means in a first position for disengagement with the protrusion apparatus results in positioning of the selectably limiting apparatus in a selected orientation.

17 Claims, 14 Drawing Figures

ROTARY SPRINKLER

The present invention relates to irrigation apparatus generally and more particularly to rotary sprinklers of the hammer type.

There are presently known a wide variety of rotary sprinklers. One common type of rotary sprinklers is the hammer type in which a stream of water engages a spring loaded hammer at intervals, thus producing intermittent long range and short range sprays.

The force of the water stream on the hammer is translated into pulsed rotary motion of the sprinkler about its axis, thus enabling the sprinkler to cover a full circle of 360 degrees about its axis. Since there exist applications where less than 360 degree coverage is desired, hammer type rotary sprinklers have been developed which enable a desired sprinkling zone to be defined. These selectable zone sprinklers conventionally include a pair of selectably positionable rings which are oriented about the axis of rotation of the sprinkler and define protrusions which engage a finger of the sprinkler mechanism, preventing its further rotation and causing it to rotate in the opposite direction.

Two examples of sprinklers of this type are models 425 and 435 manufactured by Naan Mechanical Works and offered on the market since 1977. Similar sprinklers are produced by other manufacturers. Sprinklers of the type described generally produce different types of sprays as they rotate in different directions. When they operate in what shall be termed a "forward" direction, a combination long range and short range spray is produced and the rotation of the sprinkler is relatively slow. When the sprinklers operate in what shall be termed a "return" mode in a direction opposite to the forward direction, the amplitude of hammer motion is restricted, normally producing a short range spray only and relatively quick rotation.

Conventional selectable zone sprinklers of the type described hereinabove may be operated in a full circle mode by positioning the finger of the sprinkler mechanism such that it does not engage the protrusions, thereby enabling the sprinkler mechanism to continue rotation without interruption.

It may be appreciated that a difficulty arises in the conversion of the sprinklers to full circle operation in that the sprinkler will continue to rotate in the direction in which it was rotating before the repositioning of the finger. This means that if the sprinkler had been operating in a return mode, it will continue to operate in a return mode. Such a result is undesirable since the return mode produces a relatively short range spray.

It is therefore desirable to provide a mechanism which insures that when the sprinkler is converted to full circle operation, it is also converted to operation in a forward direction.

Presently known sprinklers, such as a sprinkler bearing the trade name BETA-II and manufactured by Nelson Inc. of the U.S.A. and Model 435 manufactured by Naan Mechanical Works employ a lever which is pivotably mounted about a first axis for operating the sprinkler rotation direction determining mechanism. A finger is rotatably mounted onto the lever for rotation about a second axis which is perpendicular to the first axis. This finger, when in a lowered orientation, engages the zone defining protrusions and when in a raised orientation, i.e. rotated about the second axis by 90°, is disengaged therefrom and permits full circle operation.

There are also known sprinklers such as Model 255/31 of Naan Mechanical Works which require that the sprinkler be arranged for forward motion in order to permit setting thereof for full circle operation.

The present invention seeks to provide a mechanism which insures that when the sprinkler is converted to full circle operation it is also converted to operation in a forward direction.

There is thus provided in accordance with an embodiment of the present invention a sprinkler including a body defining a nozzle arranged to provide a stream of pressurized liquid, spring loaded stream deflector and hammer means for intermittently engaging the stream and providing in response to the engagement a force causing intermittent rotation of the body about a rotation axis, apparatus for selectably limiting the amplitude of motion of the stream deflector and hammer means and thus determining the direction of rotation of the body and the overall range of the spray produced and having first and second orientations corresponding to rotation in forward and return directions, selectably positionable protrusion apparatus for defining the azimuthal limits of a desired irrigation zone, finger apparatus associated with the selectably limiting apparatus for determining the orientation thereof and being selectably positionable in a first position for dis-engagement from the protrusion apparatus and in a second position for engagement therewith, the finger apparatus being constructed such that positioning of said finger apparatus in the first position results in positioning of the selectably limiting apparatus in a selected orientation. For the purposes of explanation herein, the selected orientation is considered to be the first orientation. It is appreciated that according to an alternative embodiment of the invention the second orientation may be the selected orientation, depending on the desired application and required spray characteristics. Further in accordance with an embodiment of the invention, the sprinkler may be constructed to permit ready selection of either the first or second orientation as the selected orientation. Alternatively only one predetermined selected orientation may be provided.

In accordance with one embodiment of the invention the finger apparatus comprises first and second elements, the first element being rotatable about a first axis for determining the orientation of the selectably limiting apparatus and the second element being rotatable relative to the first element about a second axis for determining whether the finger apparatus is in the first or second position, the first and second axes being non perpendicular and rotation of the second element for causing the finger apparatus to assume the first position including a force component in the direction required to cause rotation of the first element for positioning the selectably limiting apparatus in the first orientation.

Further in accordance with this embodiment of the invention the first and second axes may be parallel and are preferably identical, and the directions of rotation resulting in realization of the first position and the first orientation are similar and preferably identical.

Additionally in accordance with an embodiment of the invention, the finger apparatus may be constructed that when the finger apparatus is in the first position and for any reason the selectably limiting apparatus is in a second orientation, engagement of the finger apparatus with the protrusion apparatus causes the selectably limiting apparatus to assume the first orientation.

It is noted that in accordance with the invention positioning of the finger means in the first position results in positioning of the selectably limiting means in a selected orientation. The term "results" as used in the specification and claims refers to an action which occurs concurrently with or following the positioning and thus distinguishes over the required pre-adjustment of the sprinkler in a given orientation in order to enable full circle operation as in the prior art.

The invention will be more fully understood and appreciated from the following detailed description taken in conjunction with the drawings in which.

Figure 7A:
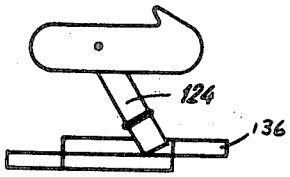
Figure 7B:
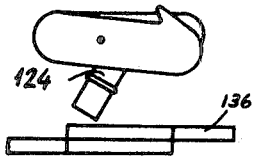
Figure 8A:
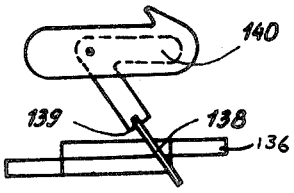
Figure 8B:
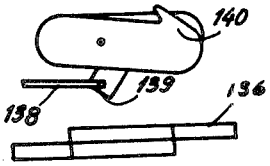

FIGS. 7A and 7B are side view illustrations of a modified version of finger apparatus for a sprinkler of the FIG. 4 type in a second position for full circle operation and in the following respective orientations, second orientation and first orientation following engagement with protrusion apparatus; and FIGS. 8A and 8B are side view illustrations of another modified version of finger apparatus for a sprinkler of the FIG. 4 type in respective first and second positions.

The general construction of a hammer-type sprinkler having selectable limited zone or full circle operation will now be described with reference to FIG. 1. It is noted at the outset that the construction of such sprinklers is well known and is shown in the 1977 catalog of Naan Mechanical Works and indicated as model 425.

Figure 1:
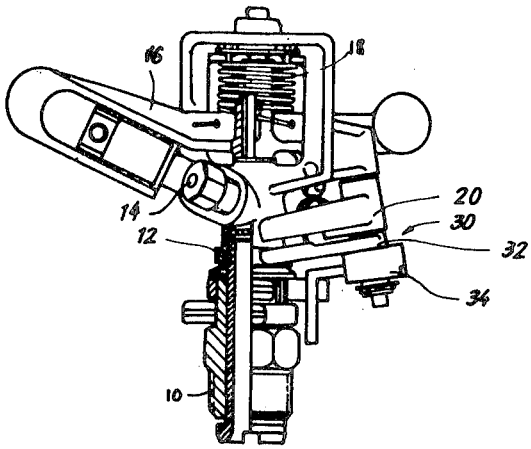
FIG. 1 is a side view illustration of a sprinkler constructed and operative in accordance with an embodiment of the present invention.

The sprinkler illustrated in FIG. 1 comprises a mounting and water coupling socket 10 onto which is rotatably mounted a body 12 which defines a nozzle outlet 14 for provision of a pressurized stream of liquid. A combination water stream deflector and hammer element 16 is rotatably mounted onto body 12 and is spring coupled thereto by a spring 18. The action of the deflector and hammer element 16 is to intermittently engage the pressurized stream of liquid for deflection thereof. This causes the deflector to move out of engagement with the stream momentarily, storing potential energy in spring 18. Spring 18 then exerts a return force which causes element 16 to impact against the body causing its rotation in intermittent steps occurring between about 100–800 times per minute. What has been described so far is forward motion of the sprinkler and it normally occurs in a clockwise direction when viewed from the top of the sprinkler.

Mounted onto body 12 is an element 20 which is selectably positionable in first and second orientations. In a first orientation, element 20 does not engage element 16 and allows forward motion of the sprinkler in the manner described hereinabove. In a second orientation, element 20 engages a portion of element 16 and severely limits the rotation amplitude thereof. By so limiting the amplitude of rotation of element 16, element 20 causes element 16 to impact thereagainst in direct response to deflection thereof by the water stream. Direct impacting of element 16 against element 20 causes rotation of the sprinkler in an opposite direction in intermittent motion producing a spray having different characteristics. This motion will be termed rotation in a return direction.

It is noted that rotation in a forward direction produces a spray of intermediate long and short range, since the stream is interrupted and deflected only intermittently. Rotation in the return direction, however, produces a greater percentage of short range spray since the spray is deflected more of the time. Further understanding of the construction and operation of this type of sprinkler may be obtained by consulting the technical literature available on the subject.

Finger apparatus 30 is associated with element 20 such that positioning of finger apparatus in a first orientation causes element 20 to be positioned in its first orientation, and positioning of finger apparatus in a second orientation causes element 20 to be positioned in its second orientation. Finger apparatus 30 is typically rotatably mounted with respect to element 20 and coupled thereto by an over-center spring arrangement which insures that element 20 assumes one of its two possible orientations.

The description up to this point has dealt with conventional, known sprinklers. The description which follows will describe a construction according to the present invention which insures that full circle operation of the sprinkler occurs in a forward rather than in a return direction. Means for insuring full circle operation in a forward direction are not known or suggested in the prior art known to applicants.

According to the illustrated embodiment of the invention, finger apparatus 30 comprises a first element 32 which is coupled to element 20 by means of an over-center spring and a second element 34 which is coaxially mounted with respect to the first element in a snap fit arrangement which permits two alternative relative orientations of the first and second elements 32 and 34, which will herein after be referred to as respective first and second positions.

Figure 2B:
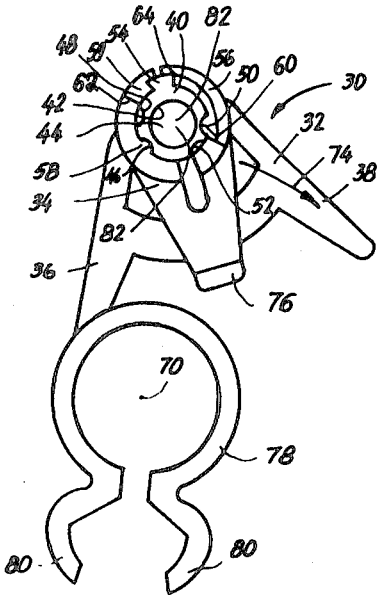
FIGS. 2A and 2B are bottom views of finger apparatus of the sprinkler of FIG. 1 in a first position for limited zone operation in respective first and second orientations corresponding to sprinkler rotation in respective forward and return directions.
Figure 2A:
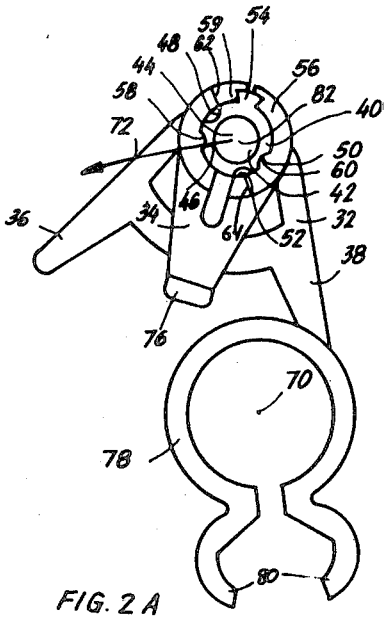

Reference is now made to FIGS. 2A and 2B which illustrate the finger apparatus 30 and the interconnection between its composite elements 32 and 34. First element 32 is a generally triangular shaped element with two wings 36 and 38 whose inner surfaces engage the sprinkler body 12 for defining the limits of motion of the first element. Wings 36 and 38 are joined at an upstanding generally cylindrical portion 40 having an elongate bore 42 for accomodating a mounting pin 44 fixed to the sprinkler body and which defines the axis of rotational motion of both elements 32 and 34. The outer surface of cylindrical portion 40 defines two sets of elongate grooves 46, 48, 50 and 52, and a wedge 54 whose depth does not extend to the plane of wings 36 and 38.

Second element 34 comprises a split mounting ring 56 whose inner surface defines a pair of elongate ridges 58 and 60 for selectable engagement with grooves 46–52 in one of two alternative positions. FIGS. 2A and 2B illustrate second element 34 in a first position relative to first element 32 and in which ridges 58 and 60 are seated in respective grooves 46 and 50. Split ring 56 also defines a recess 59 along a portion of the circumference thereof for accomodating wedge 54. The recess walls 62 and 64 define the limits of the relative positions of the first and second elements by engagement with wedge 54.

FIG. 2A illustrates the finger apparatus in a first orientation, which as noted above, causes element 20 to assume a first orientation with the result that the sprinkler rotates about its axis 70 in a direction indicated by an arrow 72, which is clockwise when viewed from the top of the sprinkler. FIG. 2B illustrates the finger apparatus in a second orientation, which as noted above, causes element 20 to assume a second orientation with the result that the sprinkler rotates about axis 70 in a direction indicated by arrow 74, which is counter clockwise when viewed from the top of the sprinkler. The shift from the first orientation to the second orientation is produced by engagement between the outward facing portion 76 of second element 34 with protrusion apparatus typically embodied in a pair of rings 78 having protruding end portions 80 which engage portion 76.

As noted above, the second element 34 may be rotated with respect to the first element 32 so as to assume a second position with respect thereto. As seen in FIGS. 2A and 2B repositioning of the second element 34 to the second position involves a rotation thereof relative to the first element in a clockwise direction about the common axis of the first and second elements which is designated by reference numeral 82.

Figure 3B:
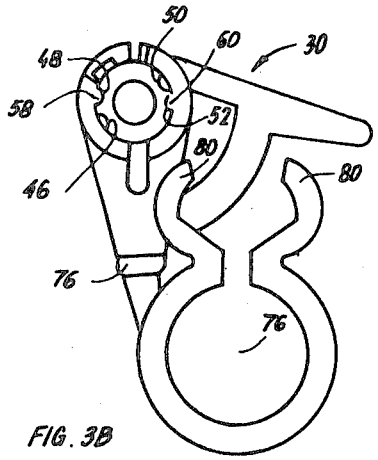
FIGS. 3A, 3B and 3C are bottom views of the finger apparatus of FIGS. 2A and 2B in a second position for full circle operation and in the following respective orientations, first orientation, second orientation just prior to engagement with protrusion apparatus, and first orientation just following engagement with protrusion apparatus.
Figure 3A:
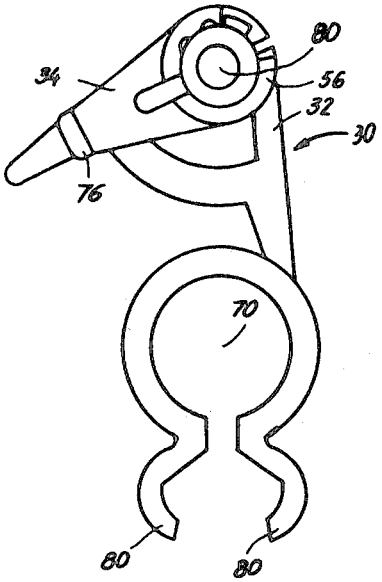
Figure 3C:
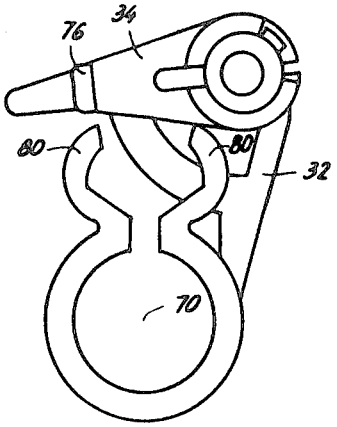

FIGS. 3A, 3B and 3C illustrate the second element in the second position. It is noted that in this position ridges 58 and 60 are seated in respective grooves 48 and 52. It is also noted that the force required to effect a shift from the first position to the second position is greater than can be produced by engagement between the facing portion 76 and the protrusion apparatus during normal sprinkler operation.

It is a particular feature of the present invention that rotation of the second element from the first to the second position in order to provide full circle operation results in the consequent rotation of the first element and thus the entire finger apparatus into the first orientation, providing forward motion of the sprinkler as desired. This is the situation illustrated in FIG. 3A. In the orientation illustrated in FIG. 3A, the facing portion 76 does not engage the protrusions 80 and the sprinkler continues to rotate in a clockwise direction (as seen from the top) indefinitely in forward motion.

There may occur circumstances wherein the second element is in the second position but the first element is in the second orientation, as when for example, the finger apparatus is accidentally rotated into the second orientation. In such a case, the sprinkler would operate in a return direction which is not desired. It is a particular feature of the invention that when the second element is in the second position but the first element is in the second orientation, as seen in FIG. 3B, rotation of the sprinkler in the return direction causes engagement between the second element at portion 76 with protrusions 80, thereby shifting the first element and the entire finger apparatus to the first orientation and causing the sprinkler to rotate in a forward direction as desired. FIG. 3C illustrates the finger apparatus in the first orientation just following engagement of portion 76 of the second element with the protrusion 80.

It is appreciated that there may be applications where a relatively short range spray may be desired during full circle operation. In such a case the grooves and ridges on the finger apparatus may be positioned such that the second orientation is the selected orientation. As a further alternative, additional grooves may be provided for permitting either the first or second orientation to be the selected orientation, the choice being determined by the directon of rotation of the second element relative to the first.

Figure 4:
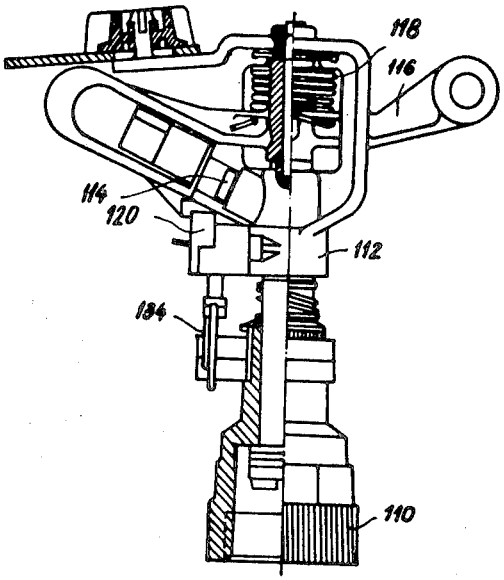
FIG. 4 is a partially cut away side view illustration of a sprinkler constructed and operative in accordance with an alternative embodiment of the present invention.

Reference is now made to FIG. 4 which illustrates an alternative embodiment of a hammer type sprinkler having selectable limited zone or full circle operation. Similarly to the sprinkler of FIG. 1, the illustrated sprinkler comprises a mounting and water coupling socket 110 onto which is rotatably mounted a body 112 which defines a nozzle outlet 114 for provision of a pressurized stream of liquid. A combination water stream deflector and hammer element 116 is rotatably mounted onto body 112 and is spring coupled thereto by a spring 18. The operation of the sprinkler is substantially similar to that described hereinabove in connection with the sprinkler of FIG. 1.

Mounted onto body 112 is an element 120 which is selectably positionable in first and second, respective lowered and raised orientations. In the first orientation, element 120 does not engage hammer element 116 and allows forward motion of the sprinkler in the manner described hereinabove in connection with the embodiment of FIG. 1. In the second, raised orientation, element 120 engages a portion of element 116 and severely limits the rotation amplitude thereof. The results of limiting the amplitude of rotation of element 116 are identical to those described hereinabove in connection with the embodiment of FIG. 1.

Figure 5:
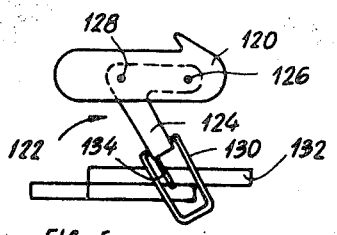
FIG. 5 is a side view illustration of finger apparatus of the sprinkler of FIG. 4 in a first position for limited zone operation.

Referring now additionally to FIG. 5 there is seen element 120 and associated finger apparatus 122. Finger apparatus 122 comprises a first element 124 which is pivotably mounted onto the sprinkler body 112 about an axis 126 and is spring coupled to element 120 by means of an over-center spring assembly, only the end 128 of which can be seen in the drawing. A second element 130 in the form of a wire ring of rectangular shape is rotatably mounted with respect to the first element and arranged to assume one of two selected positions. In a first position, element 130 is raised and does not engage the protrusion apparatus 132, thereby permitting full circle operation of the sprinkler. In the second position, element 130 is lowered, as seen in FIG. 5 and engages the protrusion apparatus for limited zone operation.

Figure 6A:
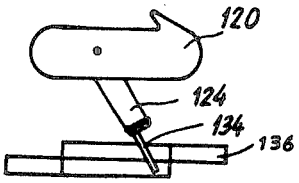
FIGS. 6A and 6B are side view illustrations of the finger apparatus of the sprinkler of FIGS. 4 and 5 in a second position for full circle operation and in the following respective orientations, second orientation and first orientation following engagement with protrusion apparatus.
Figure 6B:
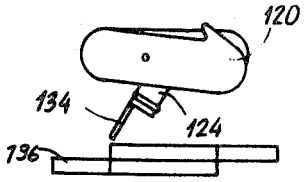

FIGS. 6A and 6B illustrate the finger apparatus in the first position and in respective second and first orientations. It is a particular feature of the invention that the first element 124 is formed with an extension 134 which, when the finger apparatus is in a second orientation, engages the protrusion apparatus 136 and as the result of such engagement positions the finger apparatus into the first orientation such that the extension 134 does not engage the protrusion apparatus and the sprinkler continues in forward full circle rotation.

FIGS. 7A and 7B illustrate an alternative embodiment of the invention wherein the first element 124 is configured to extend into engagement with the protrusion apparatus 136 when in a second orientation and to be urged into a first orientation by such engagement. No extension 134 is required.

FIGS. 8A and 8B illustrate a further alternative embodiment of the present invention which is similar to the construction of the embodiment illustrated in FIGS. 5, 6A and 6B and differs therefrom in that the second element 138 is rotatably mounted about an axis 139 which is parallel to the axis of rotation 140 of the first element relative to the sprinkler body. This is a particular feature of the invention since it insures that rotation of the second element to the first position causes rotation of the first element about axis 140 to the first orientation.

According to a further alternative embodiment of the invention axis 139 may be selected to be coaxial with axis 140. In such a case suitable rotation restriction means are probably required to prevent rotation of the second element to the first position during normal operation of the sprinkler.

It will be appreciated by persons skilled in the art that the invention is not limited by what has been particularly shown and described hereinabove. Rather the scope of the present invention is defined only by the claims which follow.

We claim:

1. A sprinkler comprising:

a body defining a nozzle arranged to provide a stream of pressurized liquid;

spring loaded stream deflector and hammer means for intermittently engaging the stream and providing in response to said engagement a force causing intermittent rotation of said body about a rotation axis;

means for selectably limiting the amplitude of motion of said deflector and hammer means and thus determining the direction of rotation of said body and the overall range of the resulting spray, said selectably limiting means having first and second orientations corresponding to rotation of the sprinkler in respective forward and return directions;

selectably positionable protrusion apparatus for defining the azimuthal limits of a desired irrigation zone;

finger means associated with said selectably limiting means for determining the orientation thereof and being selectably positionable in a first position for disengagement from said protrusion apparatus and in a second position for engagement with said protrusion apparatus, said finger means being constructed such that positioning of said finger means in said first position results in positioning of the selectably limiting means in a selected orientation.

2. A sprinkler according to claim 1 and wherein said finger means comprises means operative in response to positioning of said finger means in said first position for positioning of said selectably limiting means in said first orientation.

3. A sprinkler comprising:

a body defining a nozzle arranged to provide a stream of pressurized liquid;

spring loaded stream deflector and hammer means for intermittently engaging the stream and providing in response to said engagement a force causing intermittent rotation of said body about a rotation axis;

means for selectably limiting the amplitude of motion of said deflector and hammer means and thus determining the direction of rotation of said body and the overall range of the resulting spray, said selectablyu limiting means having first and second orientations corresponding to rotation of the sprinkler in respective forward and return directions;

selectably positionable protrusion apparatus for defining the azimuthal limits of a desired irrigation zone;

finger means associated with said selectably limiting means for determining the orientation thereof and being selectably positionable in a first position for disengagement from said protrusion apparatus and in a second position for engagement with said protrusion apparatus, said finger means being constructed such that positioning of said finger means in said first position results in positioning of the selectably limiting means in a selected orientation;

and wherein said finger means comprises first and second elements, said first element being rotatable about a first axis for determining the orientation of said selectably limiting means and said second element being rotatable relative to said first element about a second axis for determining whether said finger means is in said first or second position, said first and second axes being non-perpendicular and arranged such that rotation of said second element for causing said finger means to assume said first position includes a force component in a direction effective for positioning said selectably limiting means in said first orientation.

4. A sprinkler according to claim 3 and wherein said first and second axes are parallel.

5. A sprinkler according to claim 4 and where said first and second axes are identical.

6. A sprinkler according to claim 3 and wherein the directions of rotation about said first and second axes for reaching said respective first orientation and first position have at least some components which are in the same direction.

7. A sprinkler according to claim 6 and wherein said directions of rotation are similar.

8. A sprinkler according to claim 1 and wherein said finger means comprises means operative when said selectably limiting means is in said second orientation and said finger means is in said first position for causing said selectably limiting means to assume said first orientation upon engagement of said finger means with protrusion apparatus.

9. A sprinkler according to claim 1 and wherein positioning of said finger means in said first position causes positioning of said selectably limiting means in said first orientation.

10. A sprinkler according to claim 1 and wherein said first element is a generally flat member arranged for limiting engagement with said body at opposite sides thereof in respective first and second orientations.

11. A sprinkler according to claim 1 and wherein said selectably limiting means is rotatably mounted about a first axis fixed with respect to said body and said first and second elements are coaxially mounted therewith.

12. A sprinkler according to claim 11 and wherein said second element defines a split ring having ridges, said first element defines a cylindrical portion engaged by said split ring and having a plurality of grooves formed therein for selectable engagement by said ridges at said first and second positions.

13. A sprinkler according to claim 1 and wherein said second element is oriented generally in the same plane as said first element in said second position and is oriented in a plane angled with respect thereto in said first position.

14. For use with a sprinkler capable of selectable limited zone and full circle operation and including spray mode selector means having first and second operational modes in opposite directions of rotation having different spray characteristics, apparatus for ensuring that positioning of the sprinkler for full circle operation results in concurrent or immediately subsequent orientation of said sprinkler in a direction having a desired spray characteristic, said ensuring apparatus comprising:

selectably positionable protrusion apparatus for defining the azimuthal limits of a desired irrigation zone;

finger means associated with said spray mode selector means, means for determining the operational mode thereof and being selectably positionable in a first position for disengagement from said protrusion apparatus and in a second position for engagement with said protrusion apparatus, said finger means being constructed such that positioning of said finger means in said first position results in operation of said spray mode selector means in a selected operational mode.

15. Apparatus according to either claims 1 or 14 and wherein said selected mode comprises said first mode.

16. Apparatus according to either claims 1 or 14 and wherein said selected mode comprises said second mode.

17. Apparatus according to either claims 1 or 14 and wherein said finger means is constructed so as to permit either said first mode or said second mode to be chosen as said selected mode by rotation of said finger means in a corresponding direction.

* * * * *

UNITED STATES PATENT AND TRADEMARK OFFICE

CERTIFICATE OF CORRECTION

PATENT NO. : 4,402,460

DATED : September 6, 1983

INVENTOR(S) : Amos Shavit & Moshe Gorney

It is certified that error appears in the above—identified patent and that said Letters Patent is hereby corrected as shown below:

IN THE ABSTRACT:

Line 5, after "engagement" delete "of".

Column 8, line 5, change "tablyu" to --tably--.

Signed and Sealed this

*Twenty-ninth* Day of *May 1984*

[SEAL]

*Attest:*

GERALD J. MOSSINGHOFF

*Attesting Officer*

*Commissioner of Patents and Trademarks*